US005735709A

United States Patent [19]

Hashiguchi et al.

[11] Patent Number: 5,735,709

[45] **Date of Patent: *Apr. 7, 1998**

[54] ZERO INSERTION FORCE CONNECTOR FOR FLEXIBLE CIRCUIT BOARDS

[75] Inventors: Osamu Hashiguchi; Kazuomi Sato, both of Tokyo, Japan

[73] Assignee: Japan Aviation Electronics Industry Limited, Tokyo, Japan

[ * ] Notice: The term of this patent shall not extend beyond the expiration date of Pat. No. 5,622,505.

[21] Appl. No.: 537,530

[22] Filed: Oct. 2, 1995

[30] Foreign Application Priority Data

Oct. 6, 1994 [JP] Japan ..... 6-242510

[51] Int. Cl.[6] ..... H01R 9/07

[52] U.S. Cl. ..... 439/495; 439/260; 439/67

[58] Field of Search ..... 439/495, 498, 439/499, 329, 67, 259, 260, 261, 262, 263, 264, 265, 77

[56] References Cited

U.S. PATENT DOCUMENTS

| | | | |
|---|---|---|---|
| 4,540,228 | 9/1985 | Steele | 439/260 |
| 4,648,668 | 3/1987 | Sinisi | 439/260 |
| 4,887,974 | 12/1989 | Ichimura et al. | 439/259 |
| 4,976,629 | 12/1990 | Werner | 439/259 |
| 5,470,245 | 11/1995 | Ichimura | 439/259 |
| 5,622,505 | 4/1997 | Hashiguchi et al. | 439/67 |

OTHER PUBLICATIONS

Japanese Utility Model Publication No. 31829/1993.

*Primary Examiner*—P. Austin Bradley
*Assistant Examiner*—Tho Dac Ta
*Attorney, Agent, or Firm*—Laff, Whitesel, Conte & Saret, Ltd.

[57] ABSTRACT

In a zero insertion force connector for flexible circuit boards, there are a housing, plural flexible circuit boards in multiple rows, an insulator holding the flexible circuit boards and displaceable in perpendicular to the flexible circuit boards in the housing, a counterpart insulator having plural pairs of broader counterpart contacts than thickness of the flexible circuit boards, and a driving member for displacing the insulator so as to incline the flexible circuit boards. When the driving member is operated, the insulator presses the flexible circuit boards. Then the flexible circuit boards incline, and connect the counterpart contacts respectively.

13 Claims, 11 Drawing Sheets

ZERO INSERTION FORCE CONNECTOR FOR FLEXIBLE CIRCUIT BOARDS

BACKGROUND OF THE INVENTION

This invention relates to a zero insertion force connector for flexible circuit boards. In particular, the present invention is concerned with the zero insertion force connector having flexible circuit boards in multiple rows.

In the manner which will later be described more in detail, a conventional zero insertion force connector for a circuit board comprises contacts fixed on an insulator in a housing, springs of a cover, and a circuit board. Japanese Utility Model Publication No. 31829/1993 is an example document of the conventional zero insertion force connector for a circuit board. The circuit board is inserted to the insulator after the cover was opened. Next, the cover is closed. Then, conductive portions of the circuit board touch surely the contacts fixed on the insulator, as the circuit board is pressed by the springs of the cover.

In a zero insertion force connector having flexible printed circuits or flexible flat cables in multiple rows, the number of involving contacts generally increases for coping with increase of the number of signals. Since insertion and pulling out of circuit boards to and from an insulator must not need strong force, the zero insertion force connector cannot avoid complicated structure in order to operate easily.

Further, the zero insertion force connector needs excellent transmission characteristics (impedance matching, elimination of cross talk, etc.). The conditions for satisfaction of the transmission characteristics and the conditions for satisfaction of the mechanical characteristics in the zero insertion force connector run almost counter to each other on design. Therefore it is very difficult to satisfy both the conditions.

SUMMARY OF THE INVENTION

It is consequently an object of this invention to provide a zero insertion force connector for flexible circuit boards with a simple structure.

It is another object of this invention to provide a zero insertion force connector for flexible circuit boards which treats a large number of signals in excellent transmission characteristics.

Other object of this invention will become clear as the description proceeds.

According to this invention, there is provided a zero insertion force connector for flexible circuit boards comprising a housing, plural flexible circuit boards in multiple rows, an insulator holding the flexible circuit boards and displaceable in perpendicular to the plural flexible circuit boards in the housing, a counterpart insulator having plural pairs of broader counterpart contacts than the thickness of the plural flexible circuit boards, and a driving member for displacing the insulator so as to incline the plural flexible circuit boards.

DESCRIPTION OF THE PREFERRED EMBODIMENT

Figure 1:
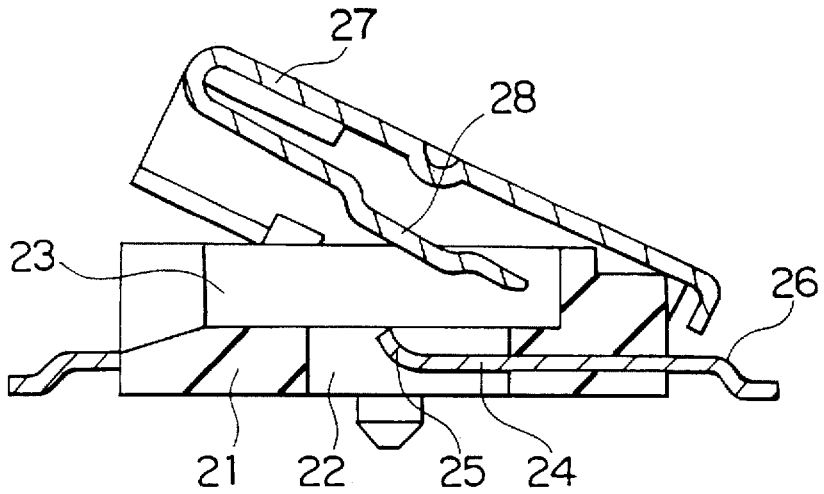
PRIOR ART FIG. 1
FIG. 1 is a schematic vertical sectional view of a conventional zero insertion force connector for a circuit board at its cover opened.
Figure 2:
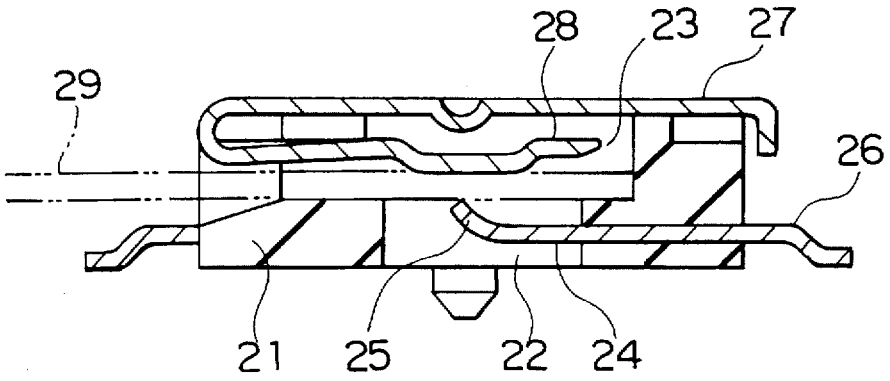
PRIOR ART FIG. 2
FIG. 2 is a schematic vertical sectional view of a conventional zero insertion force connector for a circuit board at its cover closed.

Referring to FIGS. 1 and 2, a conventional zero insertion force connector for a circuit board will first be described in order to facilitate an understanding of this invention.

The conventional zero insertion force connector for a circuit board comprises an insulator 21 in a housing (not shown), a cover 27 pivoted on the insulator 21, and a circuit board 29. The insulator 21 has a hole 22 at the central portion and a groove 23 at the upper portion thereof. Contacts 24 are molded on the insulator 21. Contacts 24 have terminals 25 and 26 at both the ends thereof. A cover 27 is at first opened, as shown in FIG. 1. After the circuit board 29 is inserted to the groove 23 of the insulator 21, the cover 27 is closed. Then conductive portions of the circuit board 29 touch surely the terminals 25 of the contacts 24, as the circuit board 29 is pressed by springs 28 of the cover 27.

In the zero insertion force connector for a circuit board being illustrated, the cover 27 closes and opens in case of insertion and pulling out of the circuit board 29 to and from the insulator 21. This renders the conventional zero insertion force connector for a circuit board bulky and troublesome. Further, the conventional zero insertion force connector for a circuit board lacks the number of contacts.

Another side, in a zero insertion force connector having flexible printed circuits or flexible flat cables in multiple rows, the number of involving contacts generally increases for coping with increase of the number of signals. Since insertion and pulling out of circuit boards to and from an insulator must not need strong force, the zero insertion force connector can not avoid complicated structure in order to operate easily.

Figure 3:
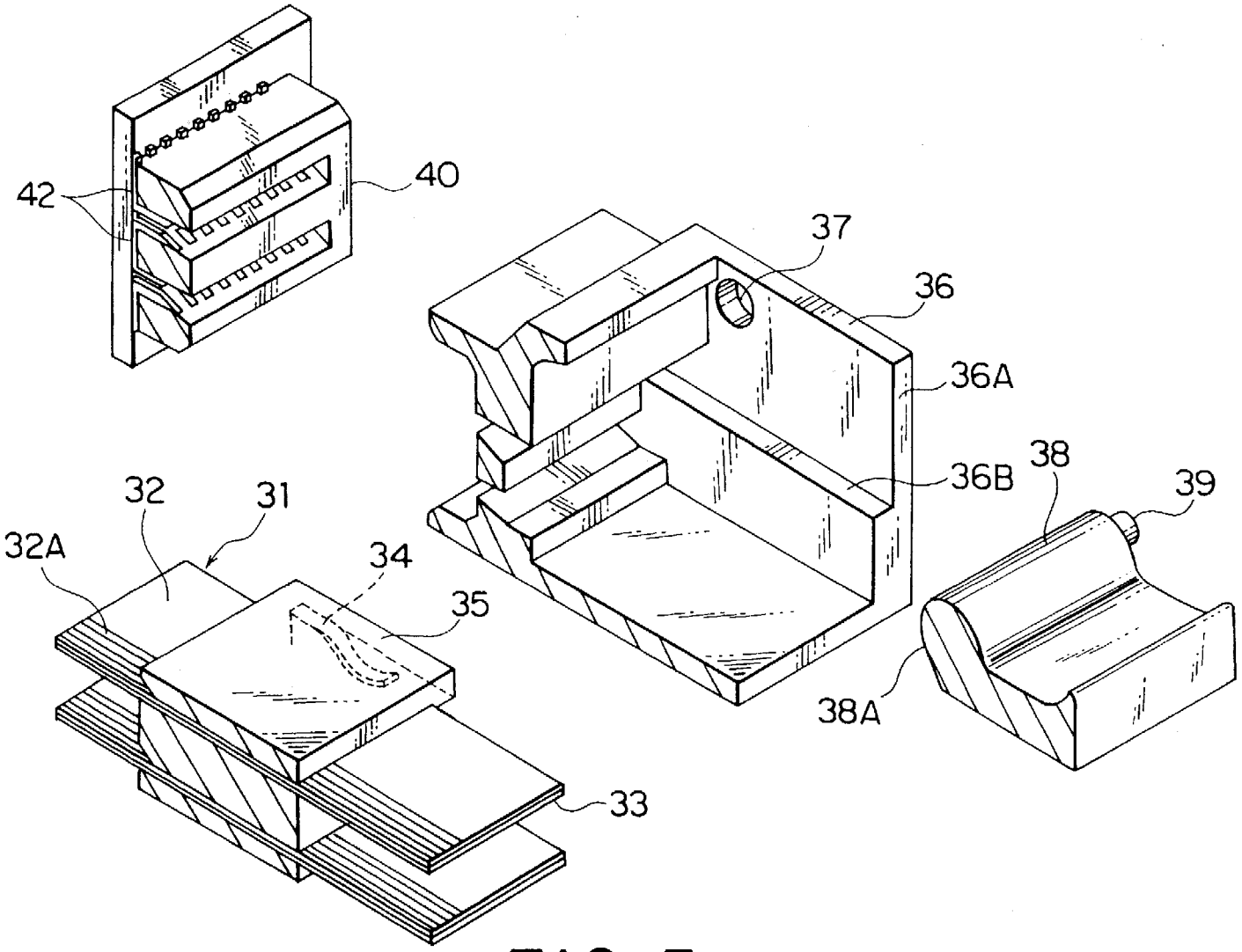
FIG. 3 is an exploded perspective sectional view of a zero insertion force connector for flexible circuit boards according to a first embodiment of this invention.
Figure 4:
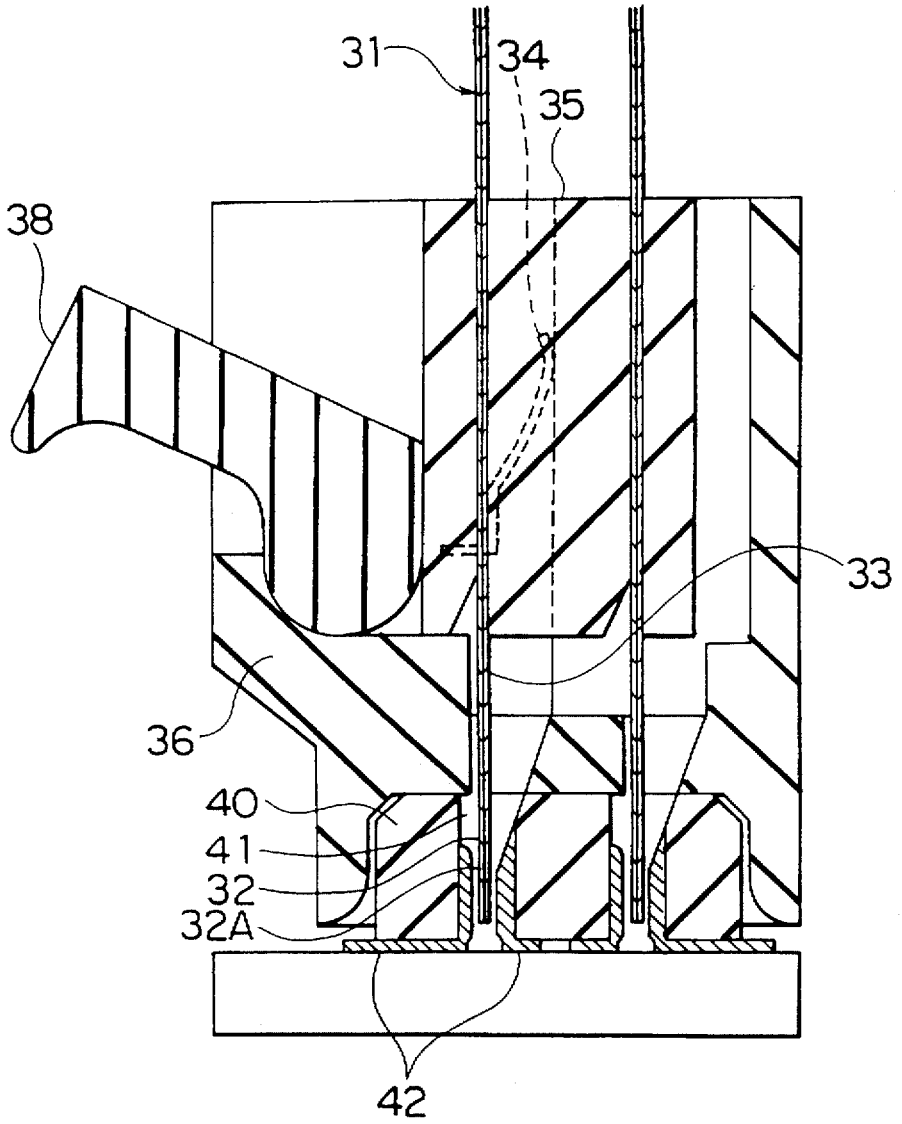
FIG. 4 is a vertical sectional view of a zero insertion force connector for flexible circuit boards according to the first embodiment of this invention in electrical disconnection.
Figure 5:
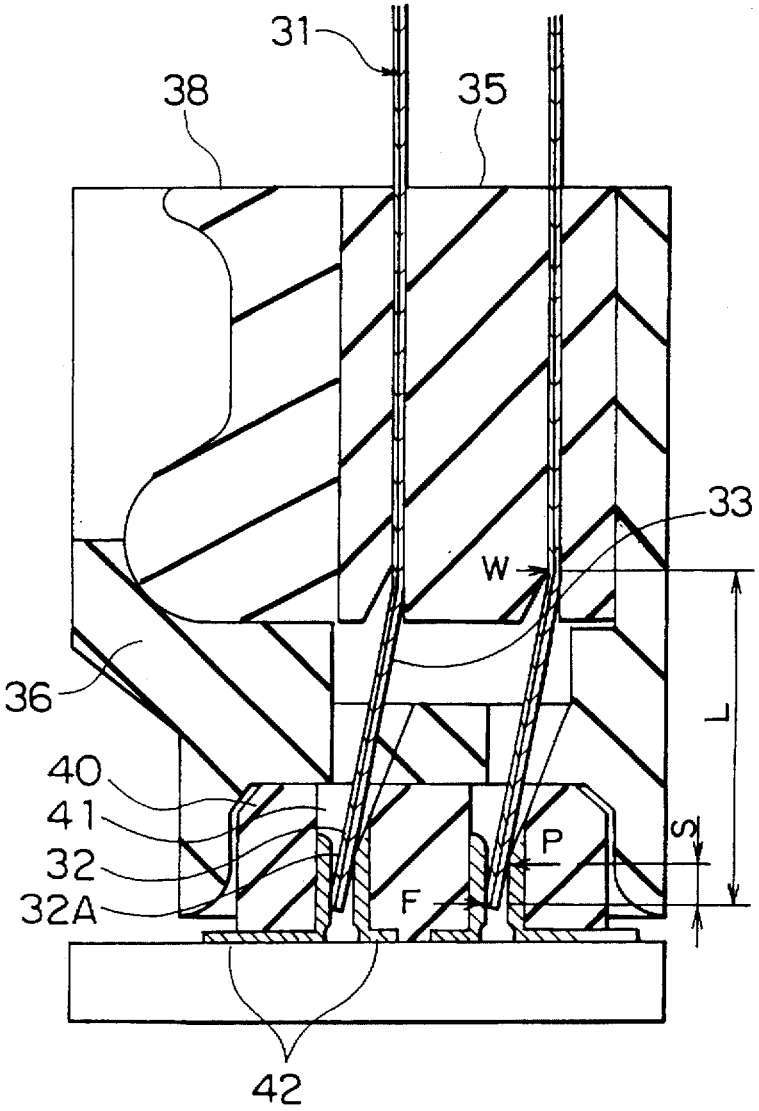
FIG. 5 is a vertical sectional view of a zero insertion force connector for flexible circuit boards according to the first embodiment of this invention in electrical connection.

Referring now to FIGS. 3, 4, and 5, the description will proceed to a zero insertion force connector for flexible circuit boards according to a preferred first embodiment of this invention.

In FIG. 3, a housing 36 has a round hole 37 at both end walls 36A in a longitudinal direction thereof. A driving member 38 has a driving projection 38A at circumferential surface 38A thereof, and a columnar projection 39 at both ends in a longitudinal direction thereof. Since the columnar projection 39 fits in the round hole 37, the driving member 38 can rotate to the housing 36.

A flexible circuit board 31 has an insulating tape 32 on the face side and an elastic plate 33 on the back side thereof. The insulating tape 32 has conducting patterns 32A on the surface thereof. The insulating tape 32, the conducting patterns 32A, and the elastic plate 33 are made of polyimide resin, copper foil, and phosphor bronze respectively.

An insulator 35 fixes the middle portions of two flexible circuit boards 31 at the predetermined distance. A pair of metallic springs 34 touches on each stair 36B of both the end walls 36A of the housing 36, and always presses the insulator 35 to the driving member 38. When the conducting patterns 32A disconnects counterpart contacts 42, a pair of springs 34 makes the insulator 35 displace by pressing to the left side in FIG. 4.

In FIGS. 4 and 5, the insulator 35 and the driving member 38 are accommodated in the upper portion of the housing 36, and are always pressed to the driving member 38 by a pair of springs 34. A counterpart insulator 40 is accommodated in the lower portion of the housing 36. The counterpart insulator 40 has two grooves 41. An interval between a pair of the counterpart contacts 42 is slightly broader than the thickness of the flexible circuit board 31. Two pairs of the counterpart contacts 42 are fixed in each groove 41 respectively coping with the conducting patterns 32A and the elastic plate 33 of the two flexible circuit boards 31.

The left side of each pair of counterpart contacts 42 is a signal contact, and the right side of that is a ground contact in FIGS. 4 and 5.

In FIG. 4, because each end of the two flexible circuit boards 31 is located in a straight state respectively, the two flexible circuit boards 31 can be inserted in the two pairs of counterpart contacts 42 without inserting resistance. When the driving member 38 rotates clockwise around its lower portion, the driving projection 38A pushes the insulator 35. Therefore the insulator 35 is displaced to the right side to lead into the position in FIG. 5 against force of a pair of springs 34. Then, each end of the two flexible circuit boards 31 which protrudes from the insulator 35 inclines, and touches to each counterpart contact 42 strongly. Consequently each conducting patterns 32A connects to each corresponding counterpart contact 42 electrically.

In electrical connection between the conducting patterns 32A of each flexible circuit board 31 and each counterpart contact 42, each flexible circuit board 31 is operated by a force of vector F and a force of vector P by each counterpart contact 42, as shown in FIG. 5. When vector W is a force loaded at a fixed end of the elastic plate 33 to the insulator 35, S is the distance between vector F and vector P, L is the distance between vector F and vector W, if L is longer than S, it is possible that vector W is very much smaller than vector F or P. Therefore the insulator 35 can be driven by weak force. In other words, the flexible circuit boards 31 can touch the counterpart contacts 42 by weak force.

Figure 6:
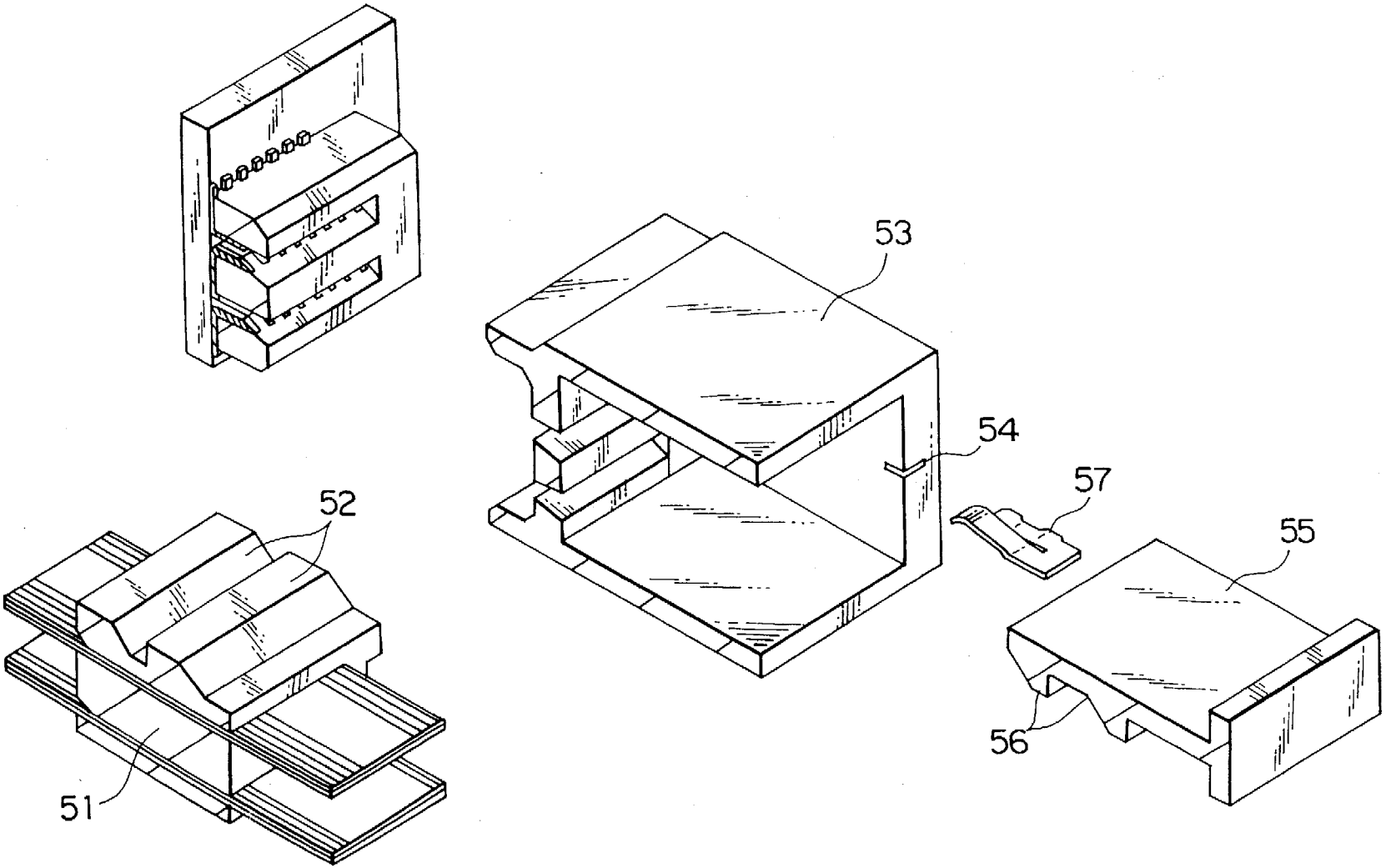
FIG. 6 is an exploded perspective sectional view of a zero insertion force connector for flexible circuit boards according to a second embodiment of this invention.
Figure 7:
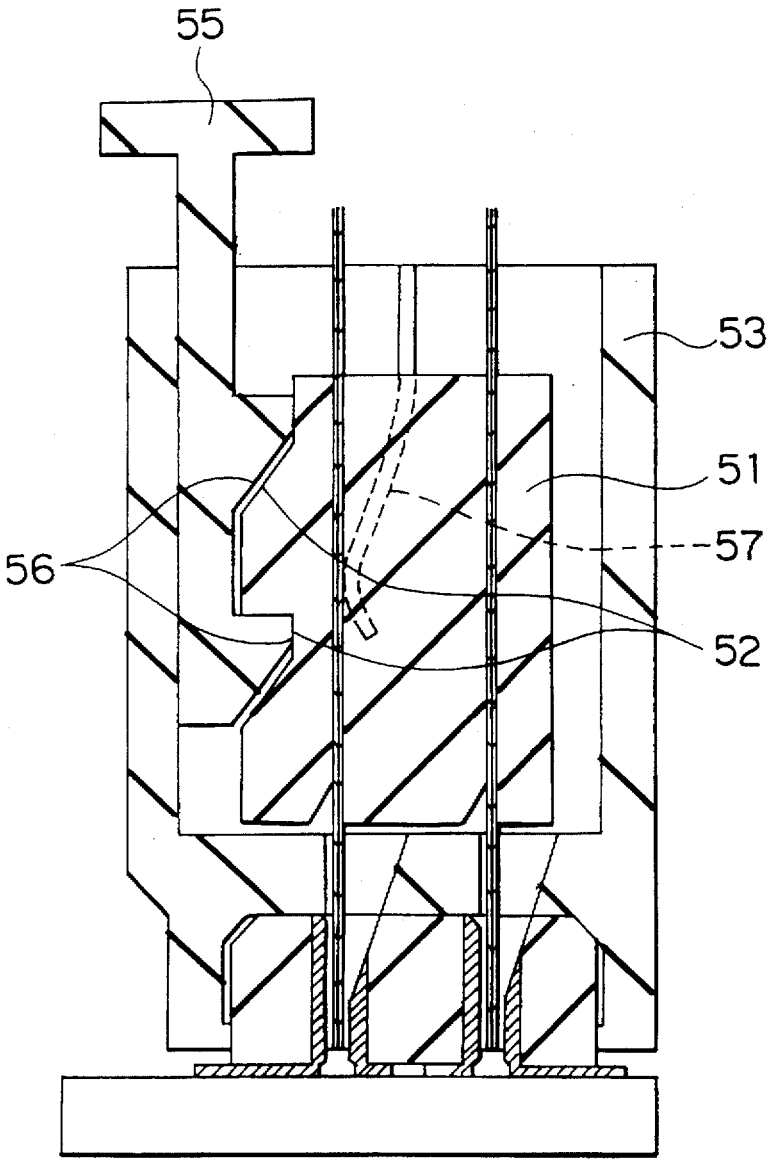
FIG. 7 is a vertical sectional view of a zero insertion force connector for flexible circuit boards according to the second embodiment of this invention in electrical disconnection.
Figure 8:
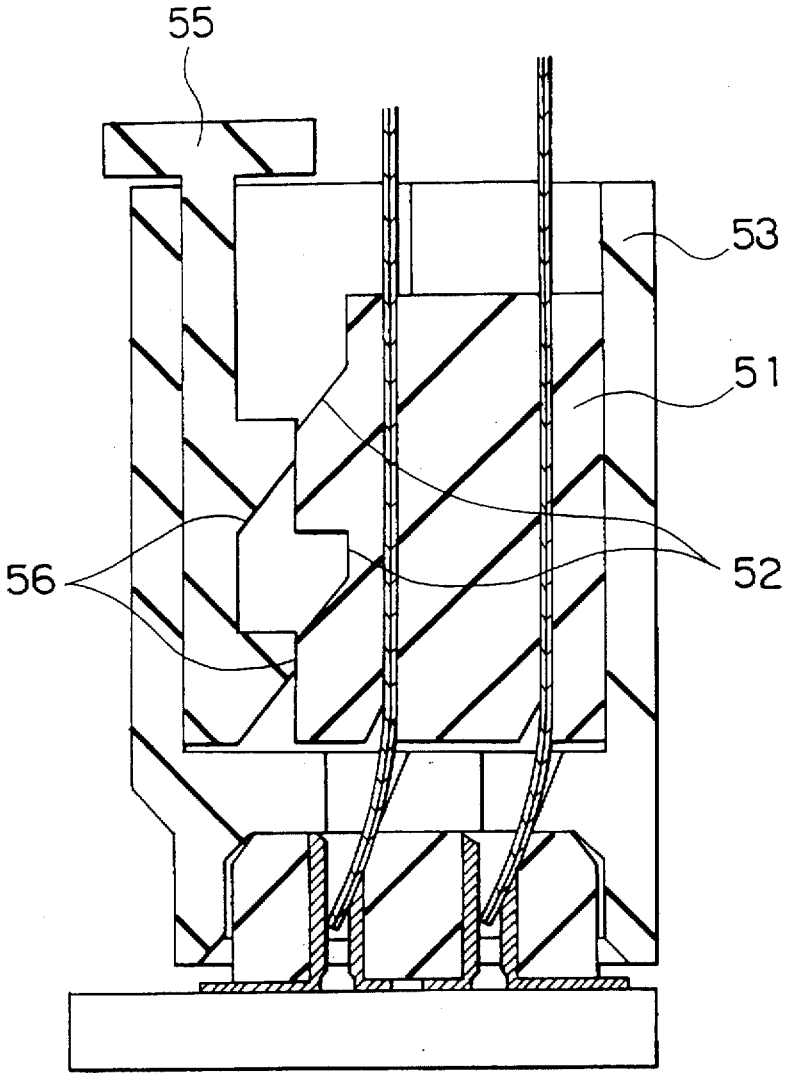
FIG. 8 is a vertical sectional view of a zero insertion force connector for flexible circuit boards according to the second embodiment of this invention in electrical connection.
Figure 9:
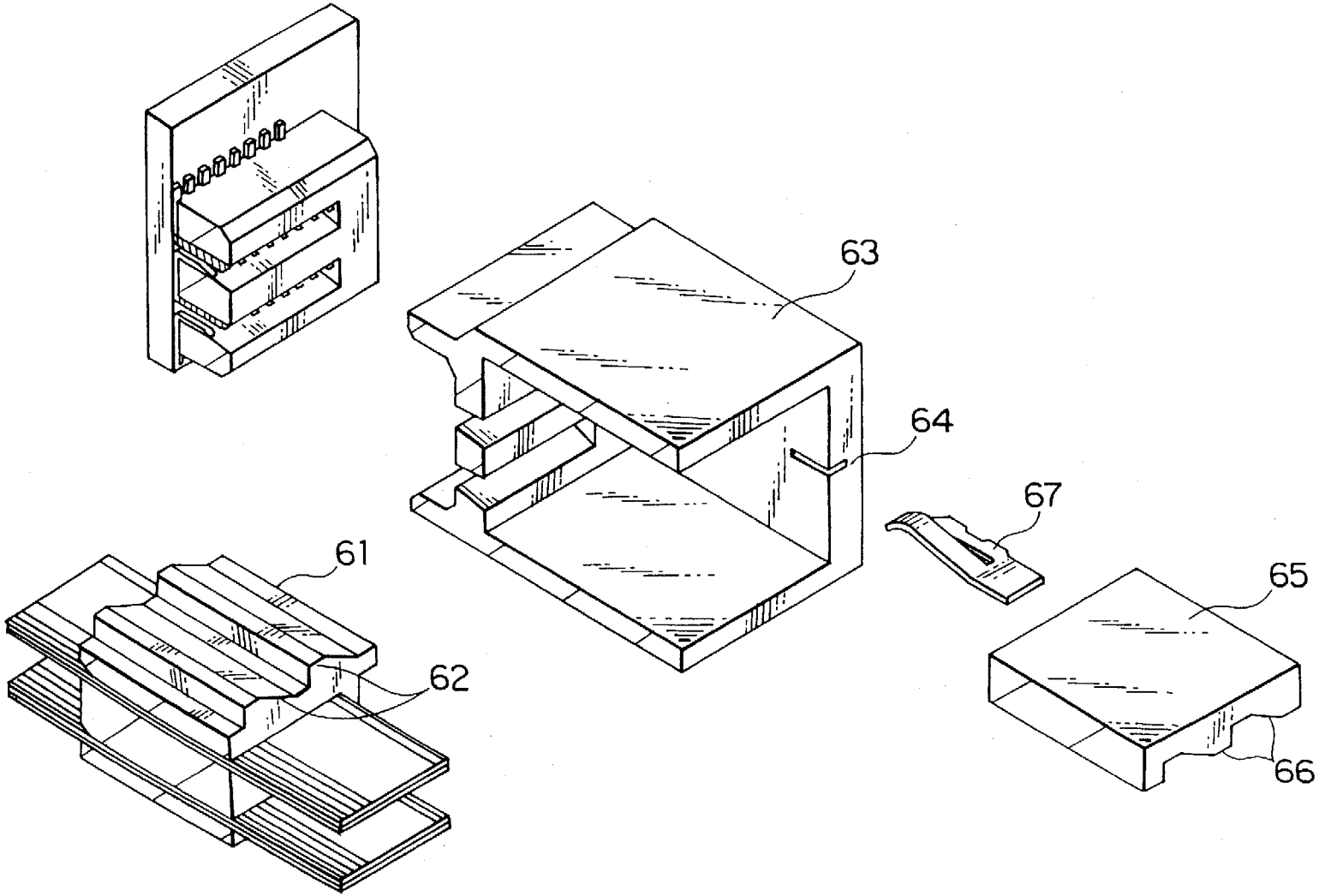
FIG. 9 is an exploded perspective sectional view of a zero insertion force connector for flexible circuit boards according to a third embodiment of this invention.

Referring now to FIGS. 6, 7, and 8, the description will proceed to a zero insertion force connector for flexible circuit boards according to a preferred second embodiment of this invention.

In FIGS. 6, 7, and 8, an insulator 51 and a driving member 55 is accommodated in the upper portion of a housing 53. The insulator 51 has tapered ruggednesses 52 at the thick direction thereof, and also the driving member 55 has tapered ruggednesses 56 at the thick direction thereof fitting in the tapered ruggednesses 52.

The principle of motion of the second embodiment of this invention is fundamentally similar to that of the first embodiment of this invention.

In FIG. 7, when the driving member 55 is pushed down, two convexnesses of the tapered ruggednesses 56 thereof run into two convexnesses of the tapered ruggednesses 52 of the insulator 51. Then the insulator 51 is displaced to the right side to lead into the position in FIG. 8.

When the driving member 55 has returned to the position in FIG. 7, the means which presses the insulator 51 to the left side in the same drawing is a pair of metallic springs 57. A pair of springs 57 is inserted to a pair of cuts 54 formed at both the sides of a housing 53. The above-mentioned means can be modified to a pair of springs 34 which is formed at both the sides of the insulator 35 in the first embodiment of this invention.

Referring now to FIGS. 9, 10, 11, 12, and 13, the description will proceed to a zero insertion force connector for flexible circuit boards according to a preferred third embodiment of this invention.

In FIGS. 9, 10, 11, 12, and 13, an insulator 61 and a driving member 65 are accommodated in the upper portion of a housing 63. The insulator 61 has tapered ruggednesses 62 at the perpendicular direction to thickness thereof, and also the driving member 65 has tapered ruggednesses 66 fitting in the tapered ruggednesses 62 at the perpendicular direction to thickness thereof.

The principle of motion of the third embodiment of this invention is fundamentally similar to that of the second embodiment of this invention.

Figure 10:
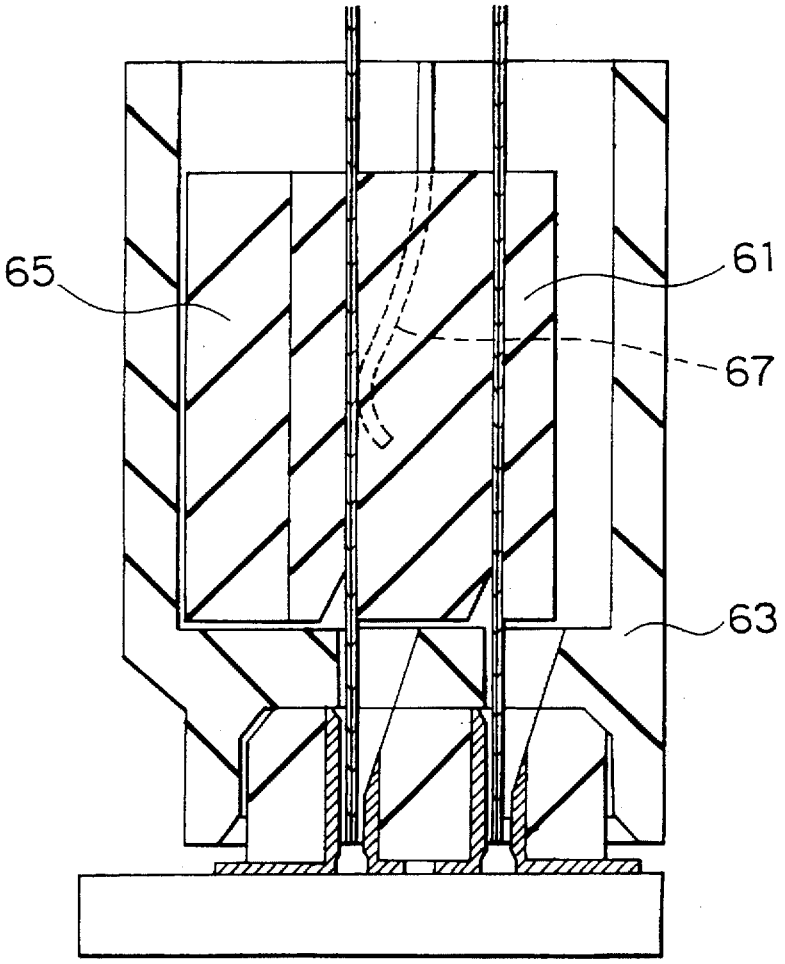
FIG. 10 is a vertical sectional view of a zero insertion force connector for flexible circuit boards according to the third embodiment of this invention in electrical disconnection.
Figure 11:
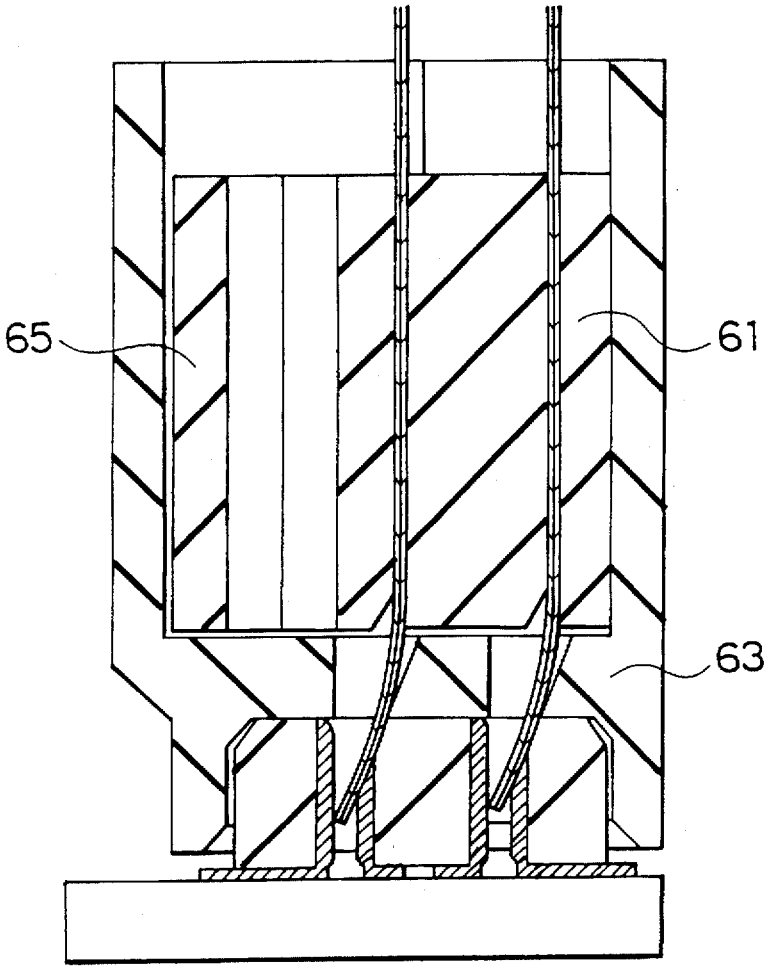
FIG. 11 is a vertical sectional view of a zero insertion force connector for flexible circuit boards according to the third embodiment of this invention in electrical connection.
Figure 12:
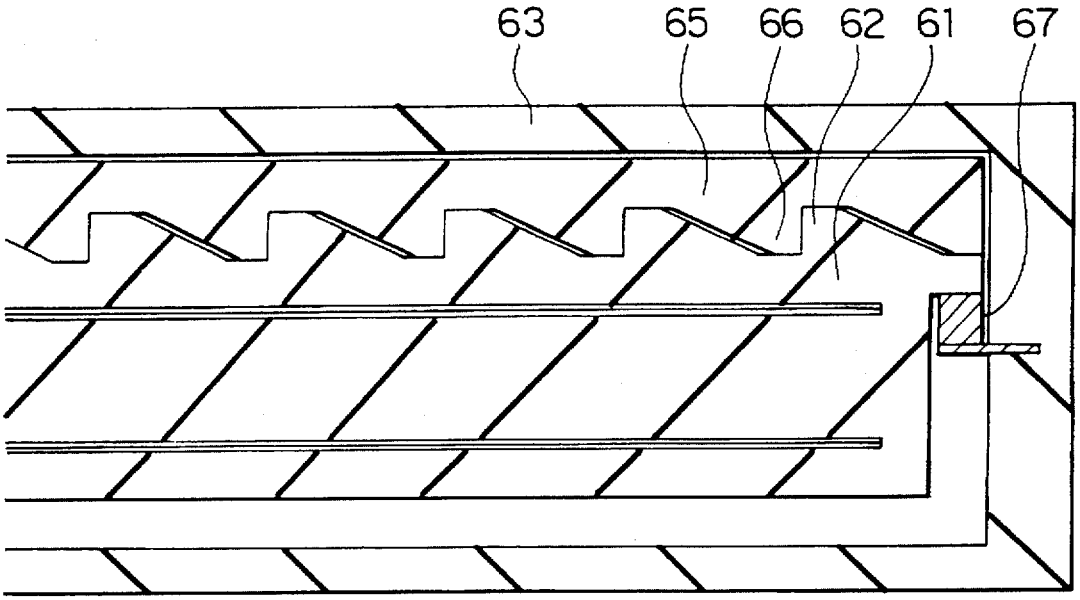
FIG. 12 is a sectional view perpendicular to the sectional view as shown in FIG. 10.
Figure 13:
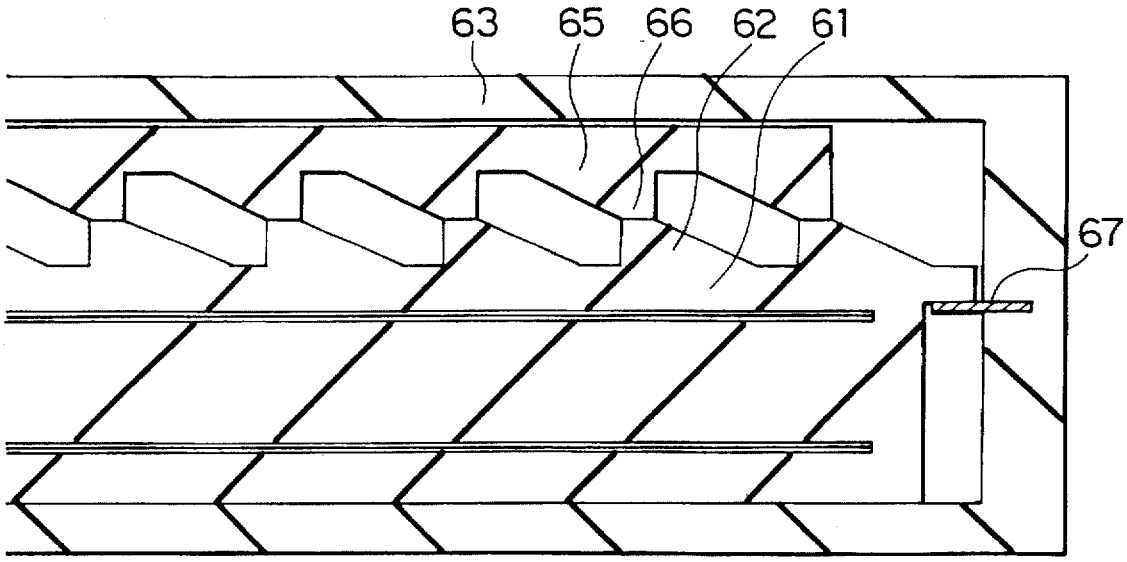
FIG. 13 is a sectional view perpendicular to the sectional view as shown in FIG. 11.

In FIG. 10, when the driving member 65 is pushed to the longitudinal direction (the direction perpendicular to the surface of this drawing paper), in other words, in FIG. 12, when the driving member 65 is pushed to the left direction, several convexnesses of the tapered ruggednesses 66 thereof run into several convexnesses of the tapered ruggednesses 62 of the insulator 61. Then the insulator 61 is displaced to the right side in FIG. 10 (the lower side in FIG. 12) to lead into the position in FIG. 11 (FIG. 13).

When the driving member 65 has returned to the position in FIG. 10, the means which presses the insulator 61 to the left side in the same drawing is a pair of metallic springs 67. A pair of springs 67 is inserted to a pair of cuts 64 formed at both the sides of a housing 63. The above-mentioned means can be modified to a pair of springs 34 which is formed at both the sides of the elastic plate 33 in the first embodiment of this invention.

Thus this invention renders the driving mechanism of the zero insertion force connector for flexible circuit boards more simple. Further, this invention renders the whole structure of the zero insertion force connector for flexible circuit boards more slim and compact.

Furthermore, this invention can displace the driving mechanism of the zero insertion force connector for flexible circuit boards by weak force.

Moreover, since this invention makes ground surfaces out of multiple surfaces of flexible printed circuits, microstrip-type transmission lines are obtained. Therefore this invention has excellent transmission characteristics (impedance matching, elimination of cross talk, etc.).

What is claimed is:

1. A zero insertion force connector for use in making connections and disconnections between a plurality of flexible circuit boards in multiple rows and counterpart contacts, said connector comprising: a housing, insulator means for rigidly holding portions adjacent to contact points of said flexible circuit boards, said insulator means being displaceable within said housing in a direction perpendicular to said flexible circuit boards, a fixed counterpart insulator having a plurality of pairs of said counterpart contacts which are separated by an interval that is broader than a thickness of said flexible circuit boards, and a driving member for displacing said insulator means so as to control an incline of said flexible circuit boards to complete and open electrical connections between said contact points and said counterpart contacts.

2. A zero insertion force connector for use in making connections and disconnections between a plurality of flexible circuit boards in multiple rows and counterpart contacts as claimed in claim 1, wherein said driving member is mounted for rotating relative to said housing so as to displace said insulator means with said flexible circuit boards.

3. A zero insertion force connector for use in making connections and disconnections between a plurality of flexible circuit boards in multiple rows and counterpart contacts as claimed in claim 1, wherein said driving member is mounted for sliding in a direction in which said flexible circuit board is inserted into said housing so as to displace said insulator means with said flexible circuit boards.

4. A zero insertion force connector for use in making connections and disconnections between a plurality of flexible circuit boards in multiple rows and counterpart contacts as claimed in claim 1, wherein said driving member is mounted for sliding perpendicularly in a direction in which said flexible circuit boards are inserted into said housing so as to displace said insulator with said flexible circuit boards.

5. A zero insertion force connector for use in making connections and disconnections between a plurality of flexible circuit boards in multiple rows and counterpart contacts as claimed in claim 1, wherein said each of said circuit boards comprises an insulating tape with conducting patterns on a first side thereof and an elastic plate on a second side thereof.

6. A zero insertion force connector for use in making connections and disconnections between a plurality of flexible circuit boards in multiple rows and counterpart contacts as claimed in claim 1, wherein said each flexible circuit board comprises a printed circuit.

7. A zero insertion force connector for use in making connections and disconnections between a plurality of flexible circuit boards in multiple rows and counterpart contacts as claimed in claim 1, wherein said insulator and said driving member are accommodated in an upper portion of said housing, and said counterpart insulator is accommodated in a lower portion of the same housing.

8. A zero insertion force connector for use in making connections and disconnections between a plurality of flexible circuit boards in multiple rows and counterpart contacts as claimed in claim 1, wherein said insulator and said driving member are accommodated in an upper portion on an entrance side of said housing for receiving said flexible circuit boards, and said counterpart insulator is accommodated in a lower portion on an opposite side of said entrance side of the same housing.

9. A zero insertion force connector for use in making connections and disconnections between a plurality of flexible flat cables in multiple rows and counterpart contacts, wherein said connector comprises a housing, an insulator means having rigid holding portions adjacent to contact points of said flexible flat cables, said insulator means being displaceable within said housing and in a direction perpendicular to said flexible flat cables, a fixed counterpart insulator has a plurality of pairs of said counterpart contacts spaced from each other by a distance which is greater than a thickness of said flexible flat cable, and a driving member mounted for displacing said insulator means so as to incline said flexible flat cables in order to make said electrical connection with said counterpart contacts.

10. A zero insertion force connector for use in making connections and disconnections between a plurality of flexible flat cables in multiple rows and counterpart contacts as claimed in claim 9, wherein said driving member is mounted for rotating relative to said housing in order to displace said insulator means with said flexible flat cables.

11. A zero insertion force connector for use in making connections and disconnections between a plurality of flexible flat cables in multiple rows and counterpart contacts as claimed in claim 9, wherein said driving member is mounted for sliding in a direction in which said flexible flat cables are inserted into said housing in order to displace said insulator means with said flexible flat cable.

12. A zero insertion force connector for use in making connections and disconnections between a plurality of flexible flat cables in multiple rows and counterpart contacts as claimed in claim 9, wherein said driving member is mounted for sliding in a direction perpendicular to a direction in which said flexible flat cables are inserted into said housing in order to displace said insulator means with said flexible flat cables.

13. A zero insertion force connector for use in making connections and disconnections between a plurality of flexible flat cables in multiple rows and counterpart contacts as claimed in claim 9, wherein said insulator means and said driving member are accommodated in an entrance side of said housing, for receiving said flexible flat cables, said counterpart insulator being accommodated in an opposite side of said entrance side of the same housing.

* * * * *